US005505387A

United States Patent [19]

Yaworski

[11] Patent Number: 5,505,387

[45] Date of Patent: Apr. 9, 1996

[54] ASSEMBLY FOR USE IN A PAINT SPRAY BOOTH

[76] Inventor: Anthony Yaworski, 266 Winter Berry Dr., Stoney Creek, Ontario, Canada, L8J 2N9

[21] Appl. No.: 376,976

[22] Filed: Jan. 23, 1995

[51] Int. Cl.[6] ..... B05B 15/08

[52] U.S. Cl. ..... 239/751; 239/209; 239/588

[58] Field of Search ..... 239/588, 750, 239/751, 173, 195, 209, DIG. 14; 134/180, 123; 248/53; 118/305

[56] References Cited

U.S. PATENT DOCUMENTS

| | | | |
|---|---|---|---|
| 3,474,801 | 10/1969 | Stotts | 134/123 |
| 3,593,730 | 7/1971 | Burchett | 134/180 X |
| 3,604,434 | 9/1971 | Hurst | 134/123 X |
| 5,033,490 | 7/1991 | Wade et al. | 138/123 |

FOREIGN PATENT DOCUMENTS

| | | | |
|---|---|---|---|
| 192338 | 8/1986 | European Pat. Off. | 118/305 |
| 2699432 | 6/1994 | France | 239/209 |

*Primary Examiner*—Kevin P. Weldon
*Attorney, Agent, or Firm*—Bereskin & Parr; Philip C. Mendes da Costa

[57] ABSTRACT

An assembly comprises:

(a) a track positioned at least part way around the perimeter of the predetermined area and having first and second ends and first and second generally parallel opposed faces extending between said first and second ends, said first opposed face having a longitudinally extending opening;

(b) a panel positioned at an intermediate point between said opposed faces and generally parallel with said opposed faces, said panel having first and second ends and extending part way between said first and second ends so as to define a first channel adjacent said first opposed face and a second channel adjacent said second opposed face;

(c) a flexible carrier having first and second ends, said first end of said carrier being secured to said second opposed face of said track near said first end of said panel, said second end of said carrier being moveable within said track from a position adjacent said first end of said track to a position adjacent said second end of said track;

(d) a manifold positioned at said second end of said carrier and having a nozzle extending through said opening;

(e) a first hose moveable with said carrier and having a first end and a second end, said first end of said hose being positioned adjacent said first end of said carrier and in flow communication with a fluid source exterior to the predetermined area, said second end of said hose being in flow communication with said manifold; and, (f) a second hose having a first end and a second end, said first end of said second hose in flow communication with said nozzle and said second end adapted for flow connection with a paint spray gun.

21 Claims, 9 Drawing Sheets

FIG. 8.
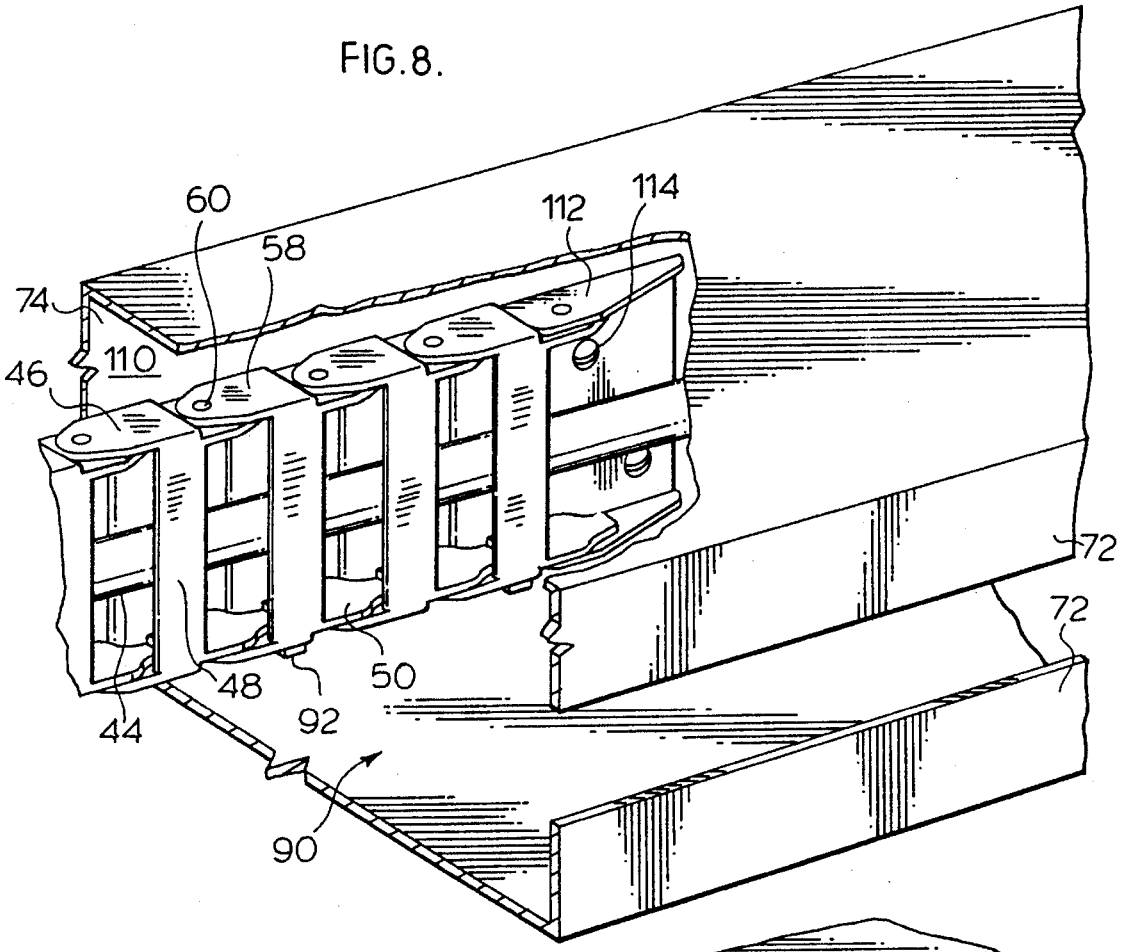
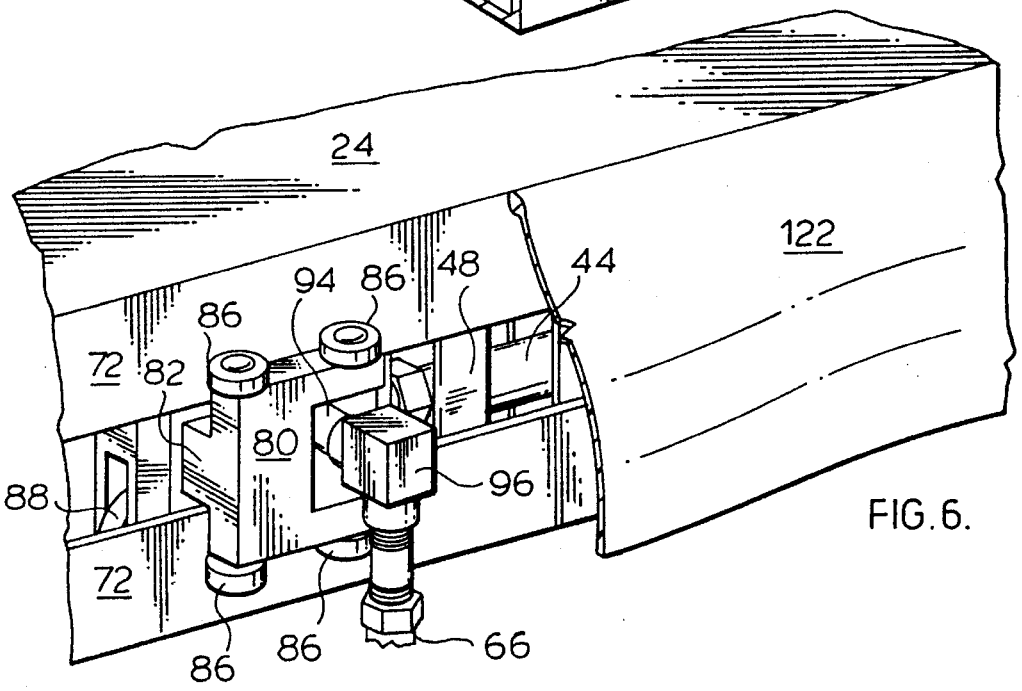
FIG. 6.

ASSEMBLY FOR USE IN A PAINT SPRAY BOOTH

FIELD OF THE INVENTION

This invention relates to booths and facilities which use hoses to carry fluids (liquids and/or gasses) to a work area, such work areas including spray booths which are used to paint various types of items of manufacture including cars, trucks and the like as well as furniture and car washes and the like. In particular, this invention relates to an assembly for use in such a booth or facility which comprises a means for guiding the feed lines around the work area.

BACKGROUND OF THE INVENTION

In order to provide a protective outer layer, many items of manufacture (e.g. pieces of equipment including cars, trucks and the like) are painted with one or more coats of paint. As the equipment ages and is used, in many cases the paint must be touched up or, alternately, one or more new coats of paint must be applied to maintain an effective anticorrosion barrier. Exemplary of such a requirement is transportation equipment including cars, trucks as well as larger equipment including railway cars.

In order to provide an effective anti-corrosion barrier, as well as to look aesthetically pleasing, the equipment is typically painted in an enclosed area ("a paint spray booth"). The use of the enclosed space reduces the amount of contaminants with are permitted to come in contact with the equipment while it is being painted. These contaminants tend to have a deleterious effect on the integrity of the coat of paint and provide weak spots where the equipment may be prone to corrosion. The use of a paint spray booth enables the amount of contaminants to be reduced and provides for a more consistent coat of paint.

The equipment is painted, for example, with a paint spray gun. Air is fed to the paint spray gun a hose which is connected to a compressor or the like. Typically, the compressor is affixed to a point outside the paint spray booth. Therefore, a sufficient length of hose must be used to permit the worker to circumnavigate the equipment so as to allow all exterior surfaces of the equipment to be painted. Typically, the hose is dragged around the equipment when it is painted. This method is disadvantageous from a safety point of view as well as a contamination point of view. In the first place, since the hose is in continual movement, the worker must keep a constant eye on the hose to ensure that he does not trip over the hose. In addition, as the hose moves, the worker must carefully guide the hose around the equipment to ensure that the hose does not come into contact with the equipment.

Typically, a worker in a paint spray booth wares a helmet that is supplied with air. In some cases, the air might be supplied via a tank which is strapped to the back of the worker. In other cases, air may be supplied to the worker via a second feed hose. This process results in twice as much hose being present on the floor of the paint spray booth and provides twice as much hose over which the worker may trip.

SUMMARY OF THE PRESENT INVENTION

In accordance with the instant invention, there is provided an assembly comprising:

a) a track positioned at least part way around the perimeter of the predetermined area and having first and second ends and first and second generally parallel opposed faces extending between the first and second ends, the first opposed face having a longitudinally extending opening;

b) a panel positioned at an intermediate point between the opposed faces and generally parallel with the opposed faces, the panel having first and second ends and extending part way between the first and second ends so as to define a first channel adjacent the first opposed face and a second channel adjacent the second opposed face;

c) a flexible carrier having first and second ends, the first end of the carrier being secured to the second opposed face of the track near the first end of the panel, the second end of the carrier being moveable within the track from a position adjacent said first end of said track to a position adjacent said second end of said track;

d) manifold means positioned at the second end of the carrier and having nozzle means extending through the opening;

e) a first hose moveable with the carrier and having a first end and a second end, the first end of the hose being positioned adjacent the first end of the carrier and in flow communication with a fluid source exterior to the predetermined area, the second end of the hose being in flow communication with the manifold means; and, f) a second hose having a first end and a second end, the first end of the second hose in flow communication with the nozzle means and the second end adapted for flow connection with a paint spray means.

The track may comprise a longitudinally extending member. This embodiment is particularly useful for painting relatively long pieces of equipment such as railway cars. In one embodiment, two opposed assemblies may be provided. Utilizing this embodiment, two workers may each paint one side of a railway car. In fact, depending upon the size of the equipment and the number of workers who may be assigned at any one time, a plurality of assemblies may be provided on each side. Thus a number of workers may be able to individually paint a portion of the equipment without getting any paint lines or air supply lines tangled.

Alternately, the assembly may comprise a continuous loop. This is particularly useful if the equipment which is being painted is relatively small such as a car. The continuous loop allows the worker to circumnavigate the car and paint all required surfaces without concern that the hose may drag against the car and thereby contaminate and mark an already painted surface.

Preferably, the second end of the panel is positioned adjacent the first end of the track and the panel extends approximately halfway towards the second end of the track. If the track is a continuous loop, then it is preferred that the panel extends approximately halfway around the track.

Preferably, the manifold means includes inner roller means positioned within the track and outer roller means positioned outside the track. A portion of the first opposed face adjacent the opening is positioned between the inner and outer roller means. Further, it is also preferred that the track has a lower surface and the manifold means further includes a lower roller means which extends between the manifold means and the lower surface.

In an alternate embodiment, the carrier has a lower surface and glide means, such as nylon panels, are positioned at intermittent points along the lower surface of the carrier, the glide means extending between the lower surface of the carrier and the lower surface of the track.

It will be appreciated that while the assembly described above only had a single feed line for a fluid, a second feed line may also be supplied. This second feed line may be used to supply paint to the spray gun.

In an alternate embodiment, the first opposed face faces outwardly from the predetermined area. Accordingly, the hose or hoses which extend from the manifold nozzle(s) extend outwardly from the track and therefore away from the predetermined area before curving down and inwardly to the predetermined area.

A flexible panel may be affixed to the track at a position above the opening. The panel extends downwardly on the first opposed face to a position below the opening. The panel assists in reducing the amount of contaminants (e.g. paint solids and dust) which tend to enter the track.

A lubricant disbursing means may be positioned at intermittent points along the carrier. As the equipment is painted, the manifold, and therefore the carrier, is moved along the track. This movement provides a continual lubricating action to reduce frictional forces which may develop at points in the track. Alternately, the track may be manually oiled from time to time.

As will be appreciated, the track, and therefore the supply hose, are preferably mounted above the work area. This reduces safety problems by maintaining the hose in a contained compartment above the work area. In addition, since the paint spray gun is connected via a relatively short hose to the feed hose positioned in the track, the worker may easily move the paint spray gun around the object being painted with minimal effort.

A further advantage of the instant invention is that the feed hose (which is positioned within the track), is at all times positioned within the work area. Therefore, the hose is not being dragged in and out of the work area with the requisite contamination which this would cause.

DESCRIPTION OF THE DRAWING

These and other advantages of the instant invention will be more fully and completely understood in accordance with the following description of the preferred embodiment of the invention in which:

FIG. 6 is an enlargement of the manifold when attached to the assembly as shown in FIG. 2;

FIG. 8 is a partially cut away side prospective view of area A of FIG. 2;

DESCRIPTION OF PREFERRED EMBODIMENT

Figure 1:
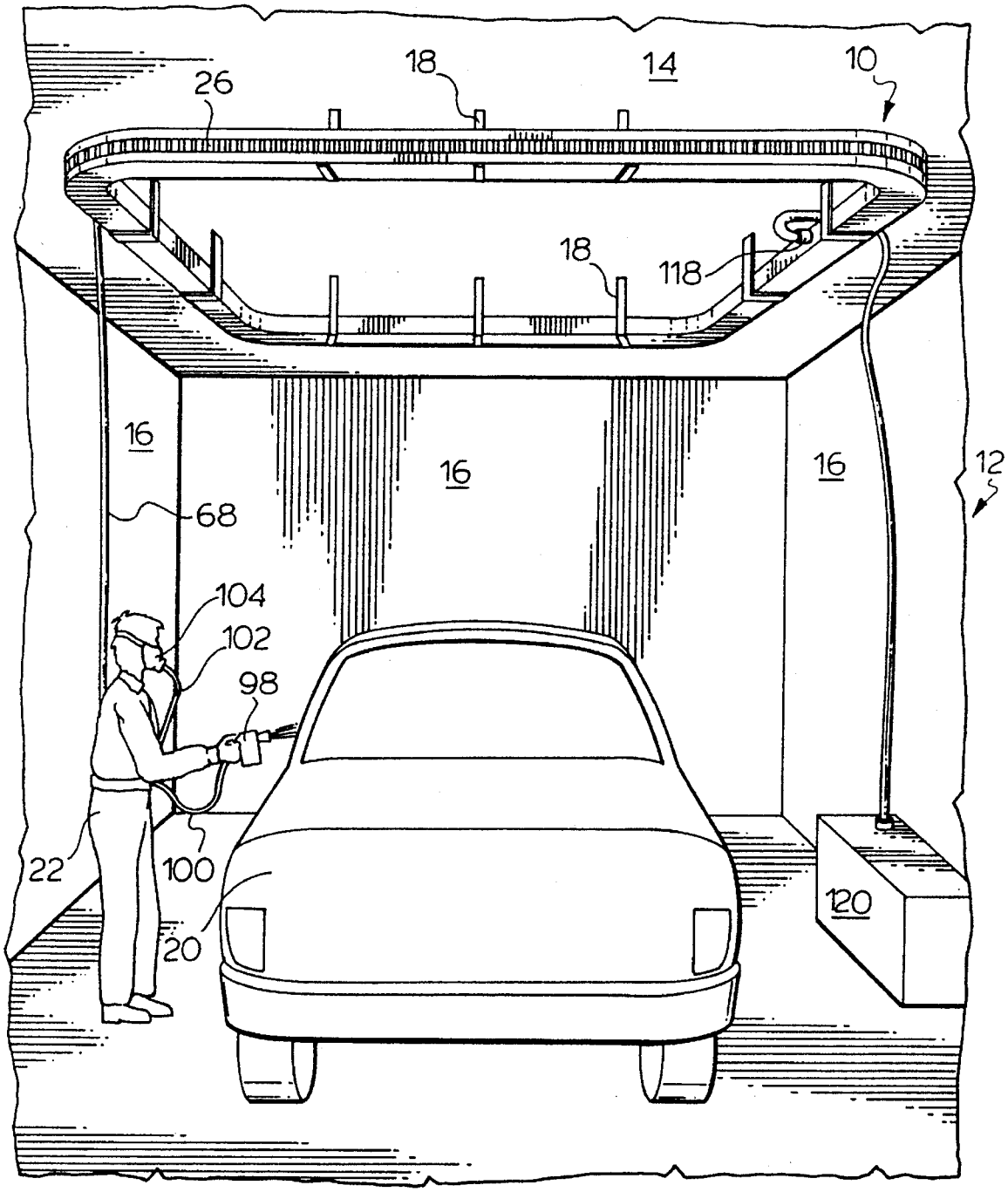
FIG. 1 is a prospective view of a paint spray booth incorporating the assembly of the instant invention.

FIG. 1 shows assembly 10 positioned in paint spray booth 12. Paint spray booth 12 has ceiling 14 and walls 16. Assembly 10 is supported from ceiling 14 by a plurality of supports 18. Supports 18 may be of any type known to those skilled in the art which will support the assembly above the work surface. As shown in FIG. 1, the paint spray booth is adapted to receive a car 20 for painting by worker 22.

While the assembly is shown in FIG. 1 as mounted above the work area, in an alternate embodiment (not shown) the assembly may comprise a longitudinally extending track which may be used for painting a relatively long piece of equipment (e.g. a railway car). In such a case, the assembly may be mounted on a wall 16. Preferably, assembly 10 is mounted sufficiently high such that it will be positioned above any equipment which is to be painted in the paint booth.

Figure 2:
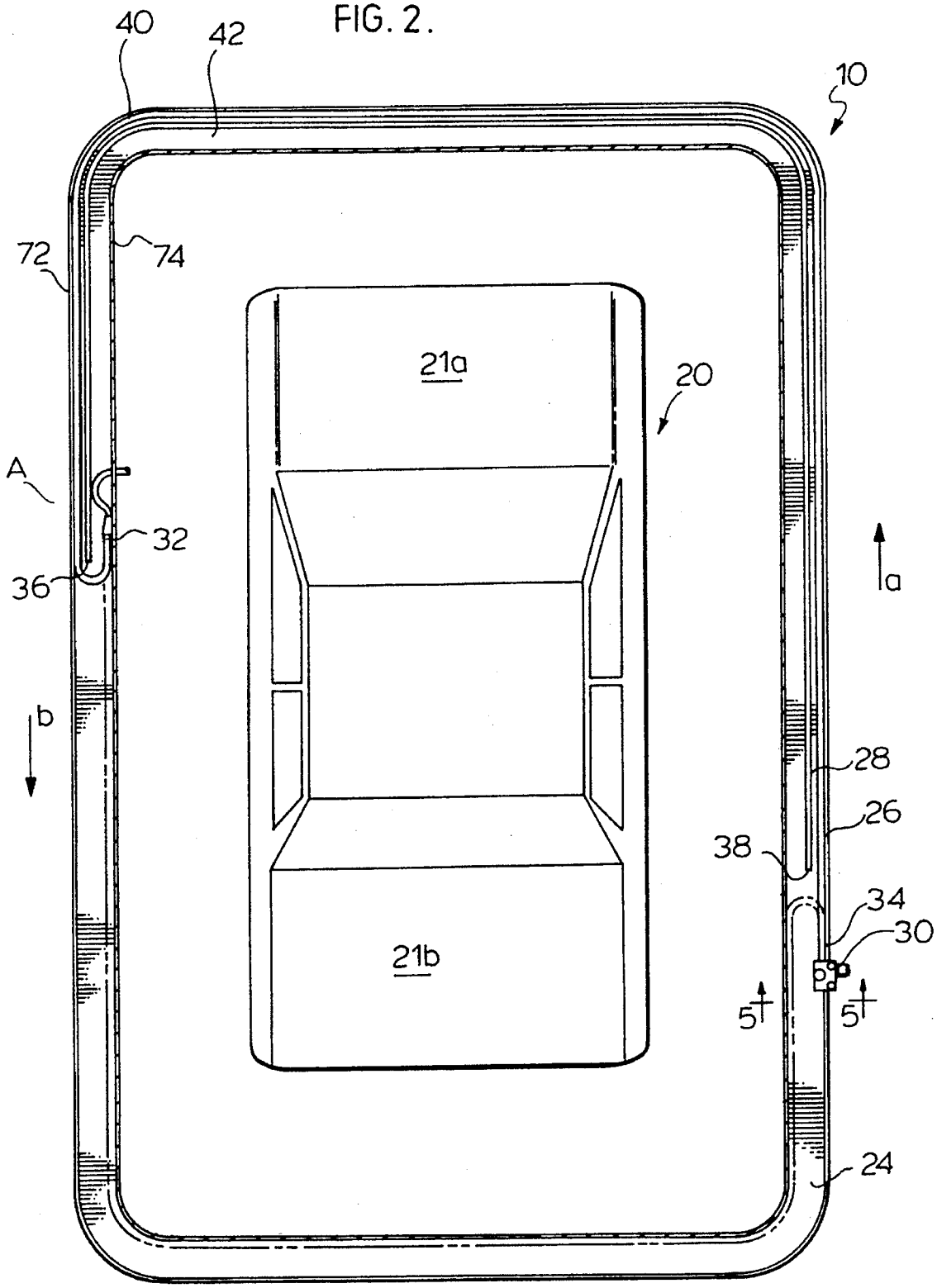
FIG. 2 is top plan view of the assembly of the instant invention when assembled in a paint spray booth.

Referring to FIG. 2, assembly 10 comprises track 24, flexible carrier 26, partition 28 and manifold means 30. Carrier 26 has first end 32 which is fixed to track 24 and second end 34 which is fixed to manifold means 30. Partition 28 has first end 36 and second end 38. Partition 38 extends only part way around track 24 so as to define first channel 40 and second channel 42.

As described in more detail below, pursuant to the preferred embodiment, carrier 26 is positioned in track 24 with a generally U-shaped bend provided therein. The flexibility of the carrier is limited in view of the width of track 24 such that, once carrier 26 has been placed in track 24, carrier 26 will not be able to fold over on itself so as to form a further generally U-shaped bend in carrier 26. Further, carrier 26 will not be able to straighten so as to eliminate the generally U-shaped bend in carrier 26. It should be appreciated that carrier 26 may be able to zigzag from side to side (e.g. in a longitudinally extending manner) but will not be able to double over on itself (i.e. will not be able to form a U-shaped bend in the track).

Figure 3:
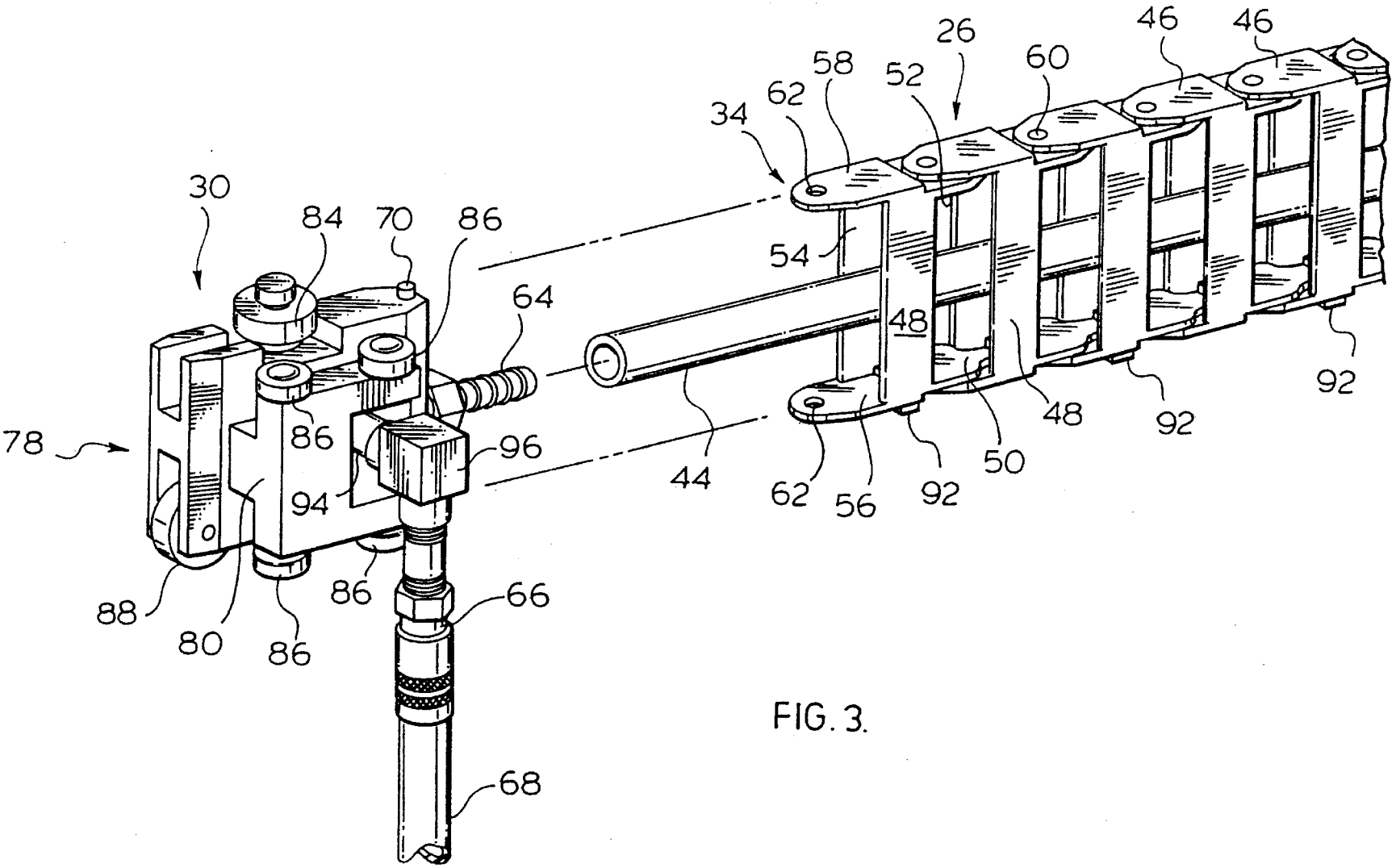
FIG. 3 is an exploded view of the carrier and the manifold of the assembly of FIG. 2.
Figure 4:
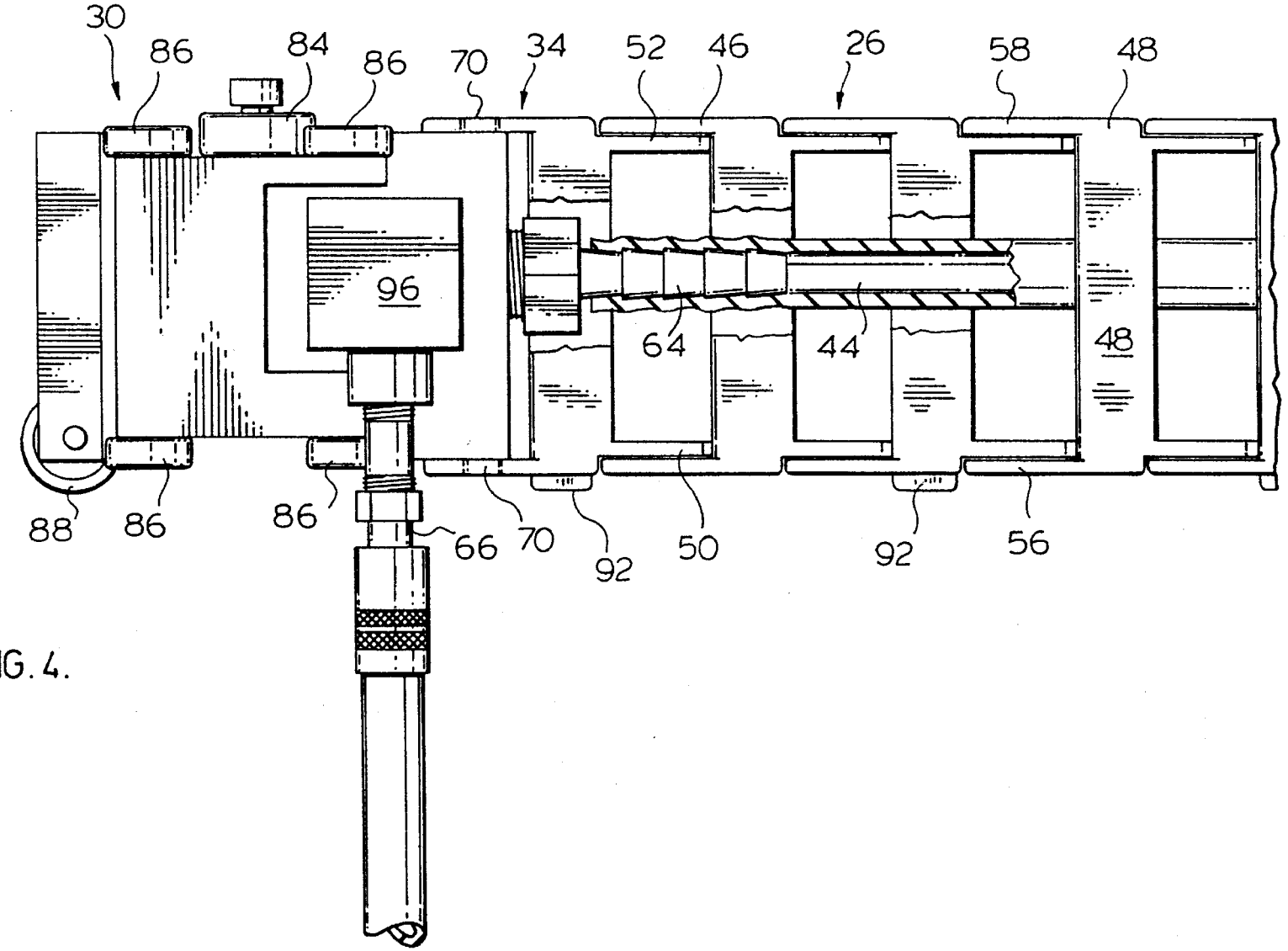
FIG. 4 is a partially cut away view of the carrier and manifold of FIG. 3.

The carrier is preferably articulated and may comprises a plurality of individual carrier elements 46. As shown in FIGS. 3 and 4, each carrier element 46 is flexible with respect to a neighbouring carrier element 46.

Each carrier element 46 may have opposed side walls 48, lower abutment member 50 and upper abutment member 52. In addition, each carrier element may have a forwardly extending lower pivot member 56 and a forwardly extending upper pivot member 58. Each pivot member 56 and 58 is preferably provided with an opening 62. Opening 62 is adapted to receive pivot pin 60 which is provided in each abutment member 50 and 52.

Abutment members 50 and 52 are tapered as they extend rearwardly form side walls 48. As one carrier element 46 flexes with respect to a second carrier element 46, one side of abutment members 50 and 52 will contact inner side 54 of side wall 48. This engagement limits the flexing of one carrier element 46 with respect to a second carrier element 46.

Carrier 26 is preferably hollow to receive feed hose 44. Each carrier element 46 is constructed of a relatively rigid material such as nylon.

Manifold 30 provides a means for receiving the fluid (liquid or gas) transmitted via hose 44 and transferring it to a hose positioned exterior to track 24. Referring to FIGS. 3 and 4, manifold 30 has a first nozzle 64 and a second nozzle 66. Nozzle 64 is adapted to be received in hose 44 providing a sealed connection between hose 44 and manifold 30. Similarly, nozzle 66 is adapted to be received in supply hose 68. Referring to FIG. 1, it will be seen that supply hose 68 extends from manifold 30 to worker 22. Nozzle 66 provides a sealed connection between supply hose 68 and manifold 30.

Manifold 30 is preferably pivotally connected to carrier 26 in the same manner that carrier elements 46 are pivotally connected to each other. Accordingly, opposed faces of manifold 30 are provided with pivot pins 70. Pivot pins 70 are adapted to be received in opening 62 of the lead carrier element.

Figure 5:
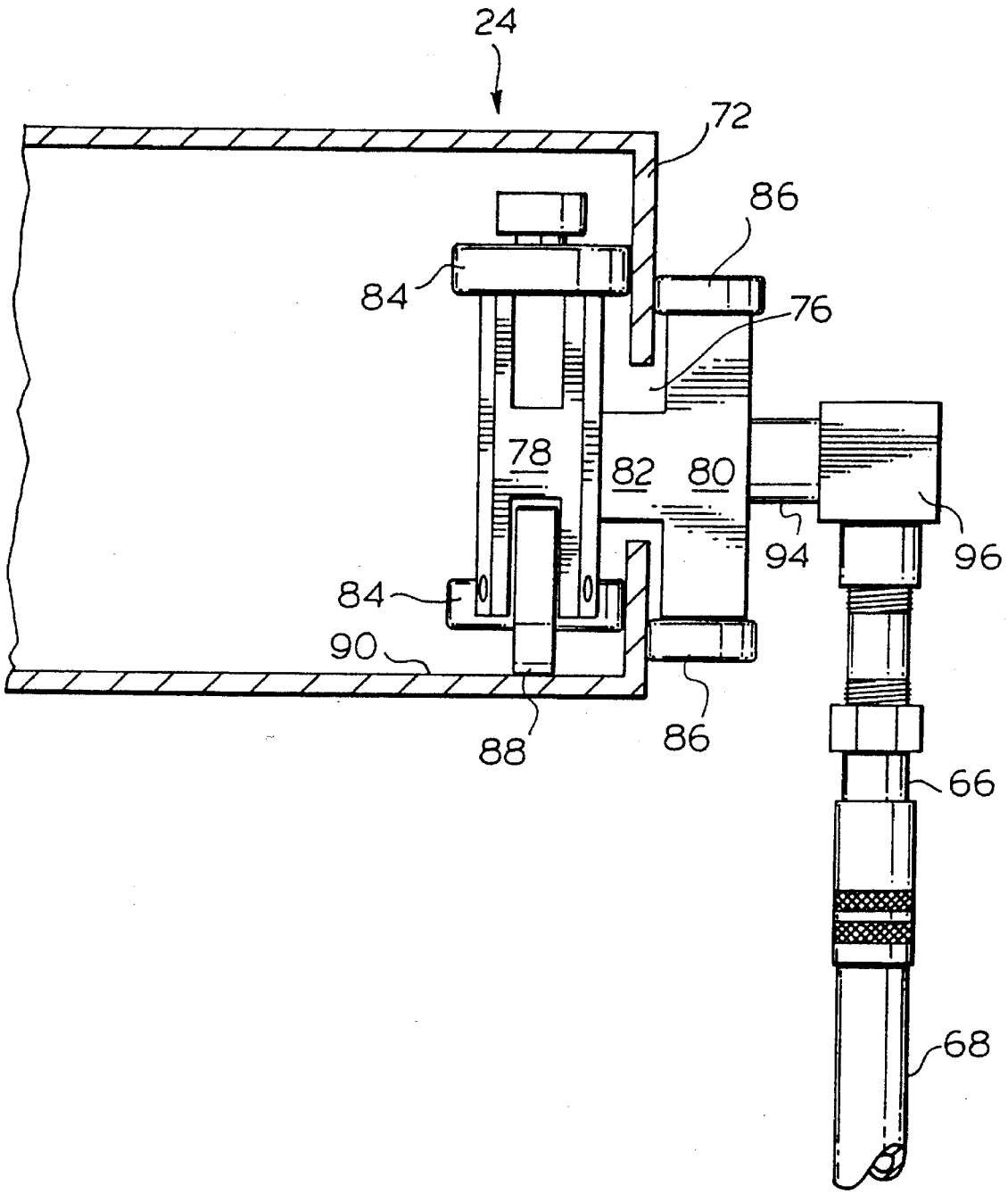
FIG. 5 is a cross-section along the line 5—5 of FIG. 2.

Referring in particular to FIGS. 5 and 6, it will be seen that a plurality of rollers may be used to mount manifold 30 in track 24. Track 24 has first and second opposed faces 72 and 74 (see FIG. 2). Opening 76 is provided in first opposed face 72 (see FIG. 5). Manifold 30 has inner portion 78 and outer portion 80 (see FIGS. 3 and 5). Portions 78 and 80 are spaced apart by transverse member 82. Inner rollers 84 are positioned at the top and bottom of inner portion 78. Similarly, outer rollers 86 are positioned at the top and bottom of outer portion 80. Accordingly, rollers 84 and 86 are positioned between first opposed face 72 and effectively sandwiched first opposed face 72 therebetween. By so mounting manifold 30, manifold 30 may travel along track 24 with minimal frictional loses.

To further reduce frictional losses and to maintain manifold 30 at a predetermined height above track 24, lower roller 88 may be provided. Lower roller 88 maintains manifold 30 at a predetermined height above lower inside surface 90 of track 24.

In order to assist carrier 26 to pass with reduced frictional losses through track 24, carrier 26 is preferably provided with glide means 92 (see FIGS. 3 and 4). Glide means 92 are preferably provided at intermittent spaces along the length of carrier 26 (e.g. every two feet). Glide members 92 are preferably formed of material which will reduce the friction as carrier 26 passes through track 24. Accordingly, glide members 92 are preferably made of nylon.

Nozzle 64 is in airflow communication with nozzle 66. Accordingly, nozzle 64 is connected with a longitudinally extending internal chamber in manifold 30 (not shown). This chamber is in air flow communication with transverse chamber 94. Transverse chamber 94 is redirected at connecting member 96 so as to travel downwardly to second nozzle 66.

Supply hose 68 is an air flow communication with worker 22. As shown in FIG. 1, supply 68 may provide high pressure air to worker 22. Worker 22 utilizes paint spray gun 98 to paint car 20. Paint spray gun 98 is provides with a canister of paint. It is to be appreciated that any paint spray gun known in the industry may be utilized in association with this assembly. The worker also carries (not shown) a divider as well as a regulator and filter. The divider diverts the air supplied via hose 68 into two streams, the first of which is fed via hose 100 to paint spray gun 98. The second is used to supply air, via a regulator and filter, through hose 102 to mask 104. Accordingly, the single supply of air may be used to supply air to the worker as well as to the paint spray gun.

Figure 9:
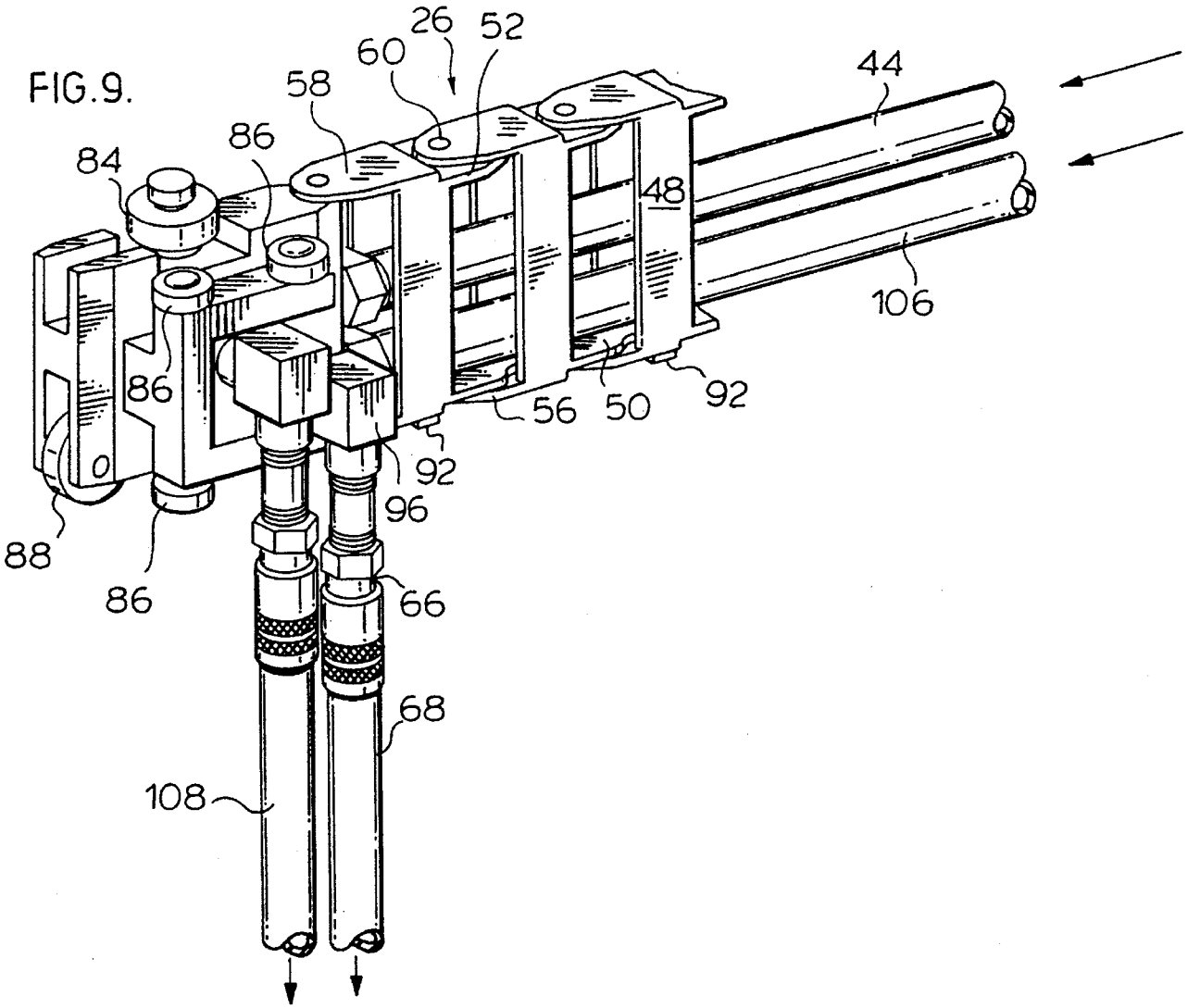
FIG. 9 is an alternate embodiment of the manifold of the assembly.
Figure 10:
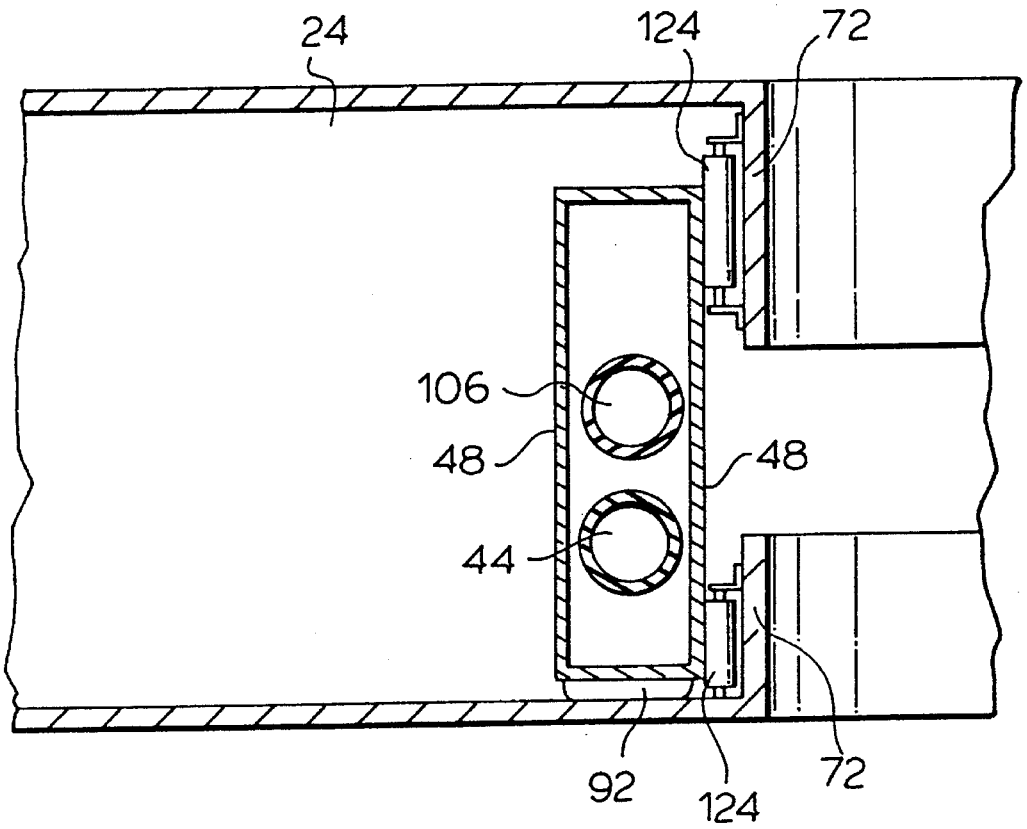
FIG. 10 is a third alternate embodiment showing a portion of the track of the assembly.

In an alternate embodiment, shown in FIG. 9, manifold means 80 may be adapted to receive two feed hoses, namely hoses 44 and 106. Feed hose 106 is in air flow communication with supply hose 106 in the same manner in which supply hose 68 is in air flow communication with feed hose 44. According to this embodiment (not shown), one of hoses 44 and 106 may be used to supply air to paint spray gun 98 and to mask 104. The other one of hoses 44 and 106 may be used to supply paint to paint spray gun 98. Alternately, (not shown), one of hoses 44 and 106 may be used to supply air to paint spray gun 98. The other one of hoses 44 and 106 may be used to supply air to mask 104. In a further alternate embodiment (not shown), three feed hoses may be employed, one to supply air to paint spray gun 98, one to supply air to mask 104 and one to supply paint to paint spray gun 98.

In a still further alternate embodiment, the worker may carry his own tank of air or oxygen which is connected via hose 102 to mask 104 (not shown). In this embodiment, supply hose 68 may be used to directly feed paint spray gun 98 without the use of the divider.

Figure 7:
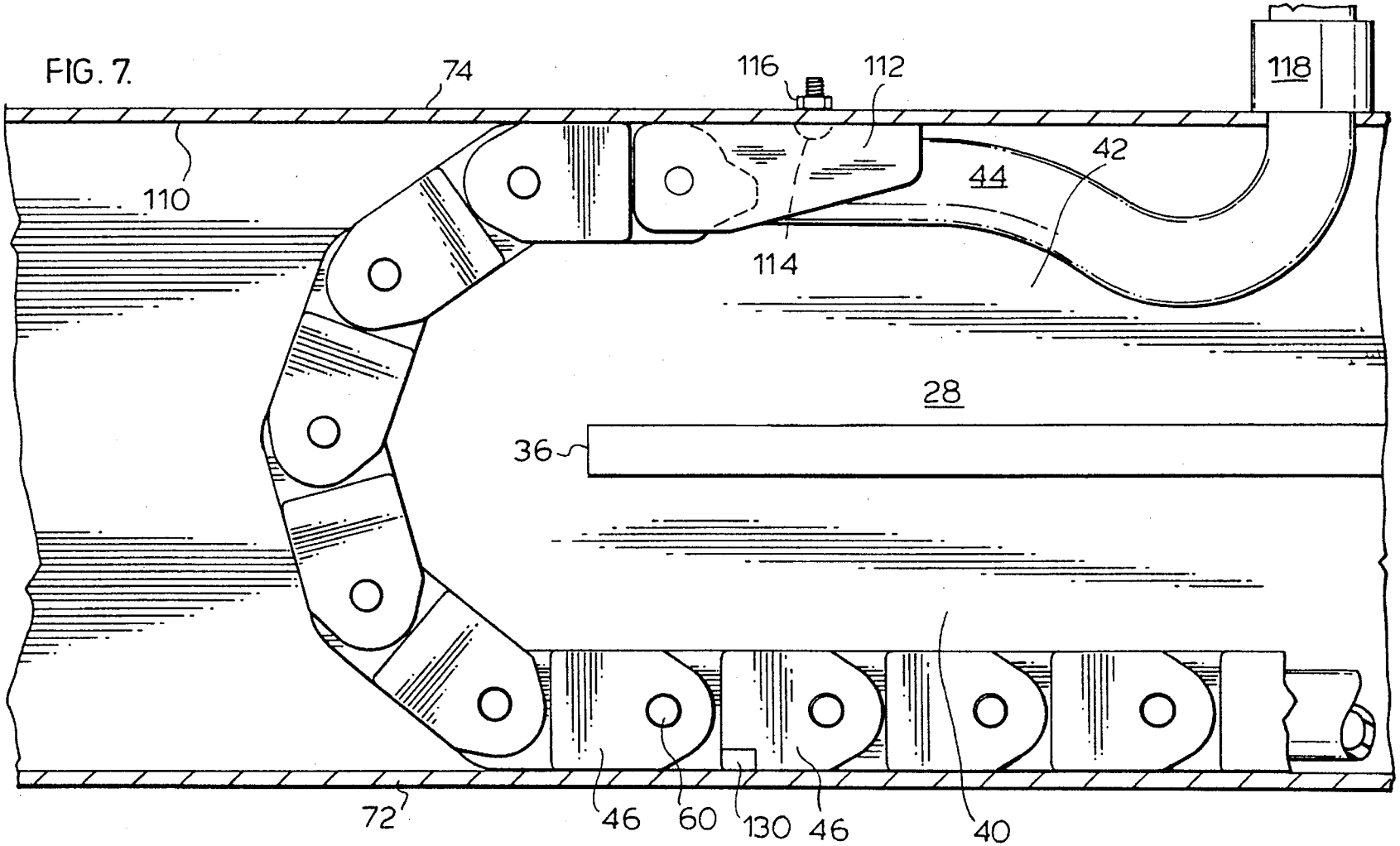
FIG. 7 is an enlargement, in top plan view with the top of the track removed, of area A of FIG. 2.

Referring to FIGS. 7 and 8, carrier 26 is mounted to inner wall 110 of second opposed face 74. In particular, end carrier unit 112 is mounted to inner wall 110 by means, for example, of screws 114 and bolts 116. Accordingly, first end 32 of carrier 26 is fixed in position in track 24. In addition, hose 44 (or both hoses 44 and 106) are mounted to inner wall 110 at a point adjacent end carrier unit 112. Hose 44 may extend through second opposed face 74 to a feed supply 120 (see FIG. 1). Feed supply 120 may be mounted either internally to paint spray booth 20 or externally thereto. Gasket 118 is used to seal track 24 where hose 24 exists therethrough. This reduces the amount of contaminants which may enter track 24.

As shown in FIG. 7, end 36 of partition 28 is preferably positioned adjacent the point where carrier 26 is affixed to inner wall 110. Preferably, partition 28 extends somewhat past the point of attachment such that carrier 26 extends longitudinally along channel 42, then transversely around partition 28 and then longitudinally down channel 40 so as to define a generally U-shaped bend. In addition, as shown in FIG. 2, partition 28 preferably extends halfway around track 24.

As shown, carrier 26 may extend from the point of attachment on wall 110 around partition 28 and along channel 40 to a point adjacent end 38 of partition 28. In this manner, manifold 30 may be moved halfway around track 24. In this manner, the worker may effectively paint hood 21A of car 20 as well as the driver's side. If the worker has to paint, for example, trunk 21B, then the worker walks in the direction of arrow A in FIG. 2 towards hood 21A. As the worker moves in the direction of arrow A, the flexible carrier extends in the direction of arrow B of FIG. 2. Since carrier 26 is articulated, the generally U-shaped portion of the carrier, described in particular with reference to FIG. 7, extends in a snake like manner through track 24 in the direction of arrow B. As the worker continues to circumnavigate the car, the U-shaped portion of carrier 26 continues to travel around track 24 to its final position as shown in doted outline in FIG. 2 adjacent end 38 of portion 28. In this manner, the worker is able to paint all surfaces of the car 20.

As will be appreciated, the use of the flexible carrier effectively permits track 24 to act as a storage for feed hose 24. Thus, the amount of hose which extends outwardly from track 24 (i.e. between manifold 30 and worker 22) remains constant. In this manner, the worker only has a small amount of hose to control and this simplifies the problem of ensuring that hose 68 does not come in contact with the object which is being painted. This is further assisted if, as shown in the drawings, opening 76 is provided in the surface of track 24 which faces outwardly from the work area.

As will be appreciated by those skilled in the art, if track 24 extends in a semi or fully continuous manner around the work area, then the corners of track 24 are preferably rounded. In addition, in order to reduce friction which may be encountered between carrier 26 and track 24, a lubricant (e.g. oil), may be occasionally sprayed into the interior of the track. Alternately, as shown in FIG. 7, a compartment 130 may be positioned at intermittent points along carrier 26.

Compartment 130 is provided with a lubricant dispensing means (e.g. a sponge) which is supplied with a lubricant (e.g. by being in communication with a refillable oil storage compartment).

To reduce contaminants (e.g. paint solids), which may form on the inner surface of track 24 and tend to create frictional drag, flexible panel 122 (see FIG. 6) may be mounted over opening 76. Flap 122 may be made of a plastic and may be mounted to a portion of track 24 above opening 76. Flap 122 extends downwardly past opening 76. Flexible cover 122 will generally sit effectively flush against opposed surface 72 except for that portion where manifold means 30 is temporarily positioned.

Alternately, or in addition, rollers 124 may be positioned on the inner side of opposed face 72 in the corners thereof.

I claim:

1. An assembly comprising:

(a) a track positioned at least part way around the perimeter of a work area and having first and second generally parallel opposed faces, said first opposed face having a longitudinally extending opening;

(b) a panel positioned at an intermediate point between said opposed faces and generally parallel with said opposed faces, said panel having first and second ends and extending part way along said track so as to define a first channel adjacent said first opposed face and a second channel adjacent said second opposed face;

(c) a flexible carrier having first and second ends, said first end of said carrier being secured to said second opposed face of said track near said first end of said panel, said second end of said carrier being moveable within said track;

(d) manifold means positioned at said second end of said carrier and having nozzle means extending through said opening;

(e) a first hose moveable with said carrier and having a first end and a second end, said first end of said hose being positioned adjacent said first end of said carrier and in flow communication with a fluid source exterior to the work area, said second end of said hose being in flow communication with said manifold means; and, (f) a second hose having a first end and a second end, said first end of said second hose in flow communication with said nozzle means and said second end adapted for flow connection with a paint spray means.

2. The assembly as claimed in claim 1 wherein said carrier has a U-shaped bend whereby said carrier may extend in a first direction along said first channel from a position adjacent said first end of said panel and in a second direction opposite to said first direction from a position adjacent said first end of said panel.

3. The assembly as claimed in claim 2 wherein said panel extends approximately half way along said track.

4. The assembly as claimed in claim 3 wherein said manifold means includes inner roller means positioned within said track and outer roller means positioned outside said track, a portion of said first opposed face adjacent said opening being positioned between said inner and outer roller means.

5. The assembly as claimed in claim 4 wherein said track has a lower surface and said manifold means further includes lower roller means which extends between said manifold means and said lower surface.

6. The assembly as claimed in claim 5 wherein said carrier has a lower surface and glide means are positioned at intermittent points along said lower surface of said carrier, said glide means extending between said lower surface and said lower surface of said track.

7. The assembly as claimed in claim 2 wherein said assembly further comprises third and fourth hoses and said manifold means has a second nozzle, said third hose moveable with said carrier and having a first end and a second end, said first end of said third hose being positioned adjacent said first end of said carrier and in flow communication with a source of air exterior to the work area, said second end of said third hose being in flow communication with said manifold means, and said fourth hose having a first end and a second end, said first end of said fourth hose in flow communication with said second nozzle means and said second end of said fourth hose is adapted for flow connection with breathing apparatus means for a worker in the work area.

8. The assembly as claimed in claim 2 wherein said first opposed face faces outwardly from the work area.

9. The assembly as claimed in claim 3 further comprising a flexible panel affixed to said track at a position above said opening and extending downwardly along said first opposed face to a position below said opening.

10. The assembly as claimed in claim 3 further comprising lubricant dispensing means positioned at intermittent points along said carrier.

11. An assembly comprising;

(a) a continuous track extending around a work area and having first and second generally parallel opposed faces, said first opposed face having an opening extending around said track;

(b) a panel positioned at an intermediate point between said opposed faces and generally parallel with said opposed faces, said panel having first and second ends and extending part way around said track so as to define a first channel adjacent said first opposed face and a second channel adjacent said second opposed face;

(c) a flexible carrier having first and second ends, said first end of said carrier being secured to said second opposed face of said track near said first end of said panel, said second end of said carrier being moveable within said track;

(d) manifold means positioned at said second end of said carrier and having nozzle means extending through said opening;

(e) a first hose moveable with said carrier and having a first end and a second end, said first end of said hose being positioned adjacent said first end of said carrier and in flow communication with a fluid source exterior to the work area, said second end of said hose being in flow communication with said manifold means; and, (f) a second hose having a first end and a second end, said first end of said second hose in flow communication with said nozzle means and said second end adapted for flow connection with a paint spray means.

12. The assembly as claimed in claim 11 wherein said carrier has a U-shaped ben d whereby said carrier may extend in a first direction along said first channel from a position adjacent said first end of said panel to a position approximately half way around said track and in a second direction opposite to said first direction from a position adjacent said first end of said panel to a position approximately half way around said track.

13. The assembly as claimed in claim 12 wherein said panel extends approximately half way around said track.

14. The assembly as claimed in claim 13 wherein said manifold means includes inner roller means positioned within said track and outer roller means positioned outside said track, a portion of said first opposed face adjacent said opening being positioned between said inner and outer roller means.

15. The assembly as claimed in claim 14 wherein said track has a lower surface and said manifold means further includes lower roller means which extends between said manifold means and said lower surface.

16. The assembly as claimed in claim 15 wherein said carrier has a lower surface and glide means are positioned at intermittent points along said lower surface of said carrier, said glide means extending between said lower surface and said lower surface of said track.

17. The assembly as claimed in claim 12 wherein said assembly further comprises third and fourth hoses and said manifold means has a second nozzle, said third hose moveable with said carrier and having a first end and a second end, said first end of said third hose being positioned adjacent said first .end of said carrier and in flow communication with a source of air exterior to the work area, said second end of said third hose being in flow communication with said manifold means, and said fourth hose having a first end and a second end, said first end of said fourth hose in flow communication with said second nozzle means and said second end of said fourth hose is adapted for flow connection with breathing apparatus means for a worker in the work area.

18. The assembly as claimed in claim 12 wherein said first opposed face faces outwardly from the work area.

19. The assembly as claimed in claim 13 further comprising a flexible panel affixed to said track at a position above said opening and extending downwardly along said first opposed face to a position below said opening.

20. The assembly as claimed in claim 13 further comprising lubricant dispensing means positioned at intermittent points along said carrier.

21. The assembly as claimed in claim 13 wherein said track is generally rectangular in shape and has curved corners and said inner surface of said first opposed face has roller means positioned in said corners.

* * * * *